US005322380A

United States Patent [19]

Crocker

[11] Patent Number: 5,322,380

[45] Date of Patent: Jun. 21, 1994

[54] LABEL PRINTER

[75] Inventor: Thomas M. Crocker, Williamsport, Pa.

[73] Assignee: Brodart Co., Williamsport, Pa.

[21] Appl. No.: 165,065

[22] Filed: Dec. 10, 1993

Related U.S. Application Data

[63] Continuation of Ser. No. 4,289, Jan. 14, 1993, abandoned.

[51] Int. Cl.[5] ..... B41J 3/02

[52] U.S. Cl. ..... 400/124; 400/611; 400/619; 400/708; 346/75; 250/571; 226/6; 226/45; 156/277; 156/538

[58] Field of Search ..... 400/103, 124, 126, 708, 400/120, 630, 611-612, 619; 101/235, 247, 248; 226/2, 6, 45; 346/75; 250/571; 156/540, 541, 542, 543, 277, 538

[56] References Cited

U.S. PATENT DOCUMENTS

| | | | |
|---|---|---|---|
| 3,323,700 | 6/1967 | Epstein et al. | 226/45 |
| 3,888,340 | 6/1975 | Huffman | 400/611 |
| 3,917,142 | 11/1975 | Guarderas | 226/45 |
| 3,949,856 | 4/1976 | Ulber et al. | 226/45 |
| 4,220,084 | 9/1980 | MacLean et al. | 101/235 |
| 4,334,471 | 6/1982 | Noyes et al. | 101/228 |
| 4,370,665 | 1/1983 | Scranton | 400/126 |
| 4,567,492 | 1/1986 | Skafvanstedt et al. | 400/619 |
| 4,841,312 | 6/1989 | Inove et al. | 400/126 |
| 4,844,629 | 7/1989 | Hoyt | 400/708 |
| 4,892,426 | 1/1990 | Steele | 400/708 |
| 5,018,443 | 5/1991 | Bolger | 101/235 |
| 5,069,562 | 12/1991 | Matsuda | 400/120 |
| 5,178,063 | 1/1993 | Wolfberg et al. | 101/226 |
| 5,187,774 | 2/1993 | Ericson | 400/630 |

*Primary Examiner*—Eugene H. Eickholt
*Attorney, Agent, or Firm*—Fiddler Levine & Mandelbaum

[57] ABSTRACT

A motorless label printer employs a matrix ink jet print head under which a continuous web of labels is moved during printing. An encoder in the path of the web is rotated to generate pulses signifying the position of the labels with respect to a reference that is signalled by detection of an aperture on the web by an electric eye. The printer includes a support for a spool of the web and a delaminator for separating the printed labels from the web substrate.

15 Claims, 6 Drawing Sheets

LABEL PRINTER

This application is a continuation of application Ser. No. 08/004,289 filed on Jan. 14, 1993, now abandoned.

BACKGROUND OF THE INVENTION

It is known in the art to print information on labels mounted on a peel-away backing which is fed under a printing head. An example of such a printer is disclosed in U.S. Pat. No. 4,341,155 to Relyea et al. for a Custom Label Printer. Printers like the one disclosed by Relyea used a motor driven system, including clutch and brake sub-systems, to move each label under a print head, to stop the movement when the label is in position, e.g., upon detection of the edge of the label, to imprint the label, and then to restart the movement of the labels until the next one is in position. Such mechanisms, which employ a continuously driven motor, and brake and clutch sub-systems to stop and start the movement of labels, are complex and expensive. Similar motor driven systems are disclosed in U.S. Pat. No. 4,717,059 to Takahashi for a Label Positioning Method and Label Feeder for Continuous Label Printer, and U.S. Pat. No. 3,921,516 to Toft et al. for a Multiple Station Label Printing Machine.

The label printers of the prior art are generally used in environments wherein high volumes of labels are to be continuously printed. Their power requirements, maintenance demands, and operator skill requirements make them unsuitable for use in environments where single labels must be periodically printed for use by workers unskilled at operating printing machinery.

SUMMARY OF THE INVENTION

The present invention overcomes the aforesaid disadvantages of the prior art by providing an apparatus for printing and dispensing labels which employs no motors, is uncomplicated and inexpensive, has few moving parts, and can be operated by unskilled persons.

More specifically, the invention includes a printer having a housing, web positioning means mounted on the housing for supporting a web having a surface which is to be imprinted with one or more images, storage means for storing representations of the images to be imprinted on the web, an ink jet print head operatively connected to the storage means and fixedly mounted on the housing and having a plurality of spaced aligned dot printing means each of which can imprint a dot on the web corresponding to a point on the image, an encoder mounted in the housing adjacent the web, movement of the web causing the encoder to rotate web engaging means fixedly mounted on the encoder means to cause movement thereof, pressure means mounted on the housing for urging the web engaging means and web together to maintain sufficient friction for positive engagement during movement of the web relative to the housing, the encoder generating relative position signals indicative of the degree of movement of the web from a reference position, the print head also being responsive to the encoder signals for printing a dot corresponding to a point on the image only when the area of the web on which the point is to be imprinted is disposed opposite the corresponding dot printing means, index sensing means responsive to the position of the web for providing a reference signal when the web is at a reference position, the print head being operatively connected to the sensing means and responsive to the sensing means reference signal for printing a dot corresponding to the image only when the area of the web on which the point is to be imprinted is a predetermined distance from the reference position.

It is therefore an objection of the invention to provide a label printer which requires no motors, clutches or brakes.

Another object of the invention is to provide a label printer which can print labels irrespective of their velocity and acceleration with respect to a print head.

Still another object of the invention is to provide a label printer wherein the force for transporting the labels is provided by the hand of the user.

A further object of the invention is to provide a label printer which is compact, light in weight, uncomplicated, and inexpensive.

Other and further objects of the invention will be apparent from the following drawings and description of a preferred embodiment of the invention in which like reference numerals are used to indicate like parts in the various views.

DESCRIPTION OF THE PREFERRED EMBODIMENT

Figure 1A:
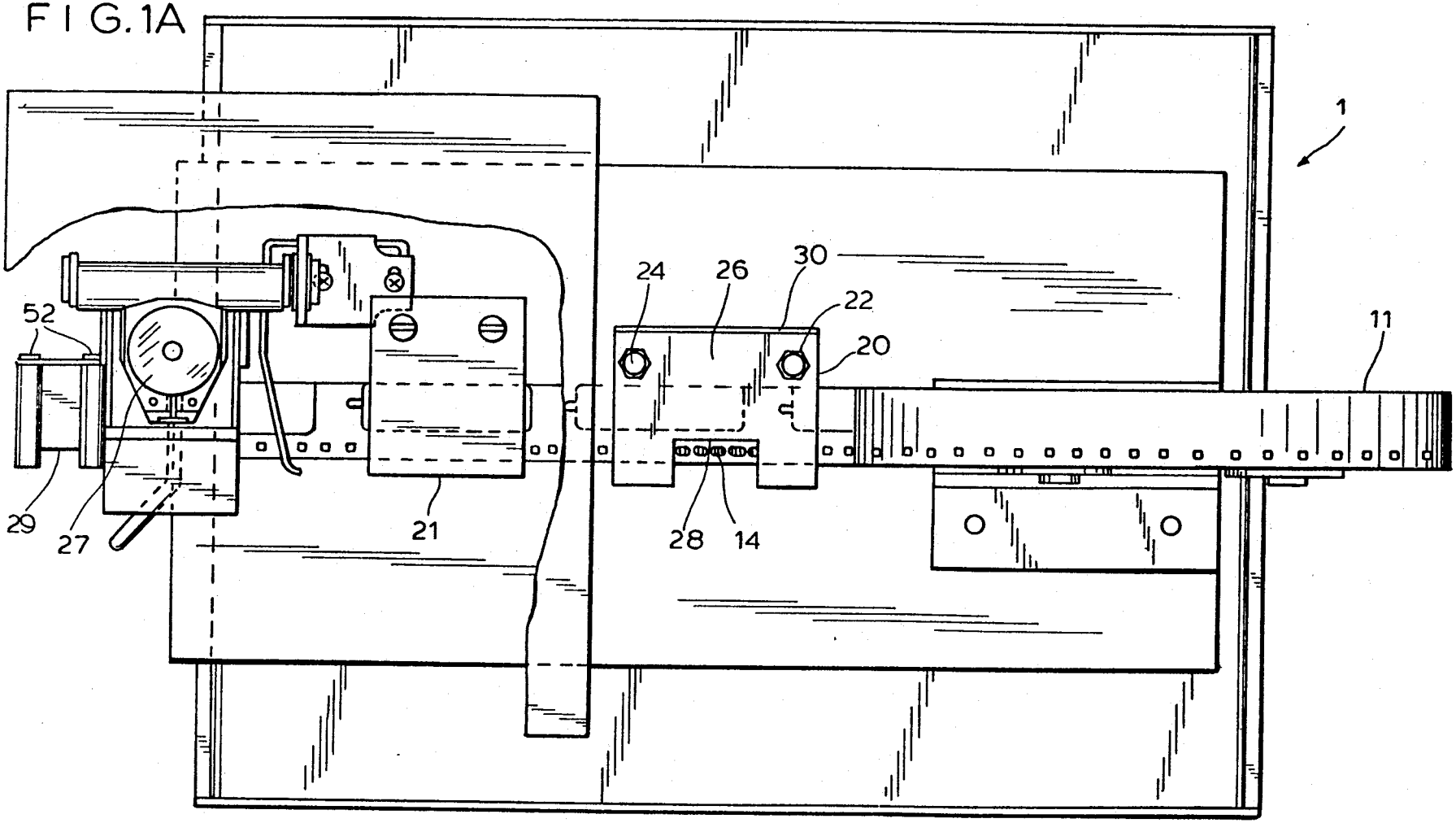
FIG. 1*a* is a top plan view of a label printer in accordance with the preferred embodiment of the invention with parts broken away.
Figure 1B:
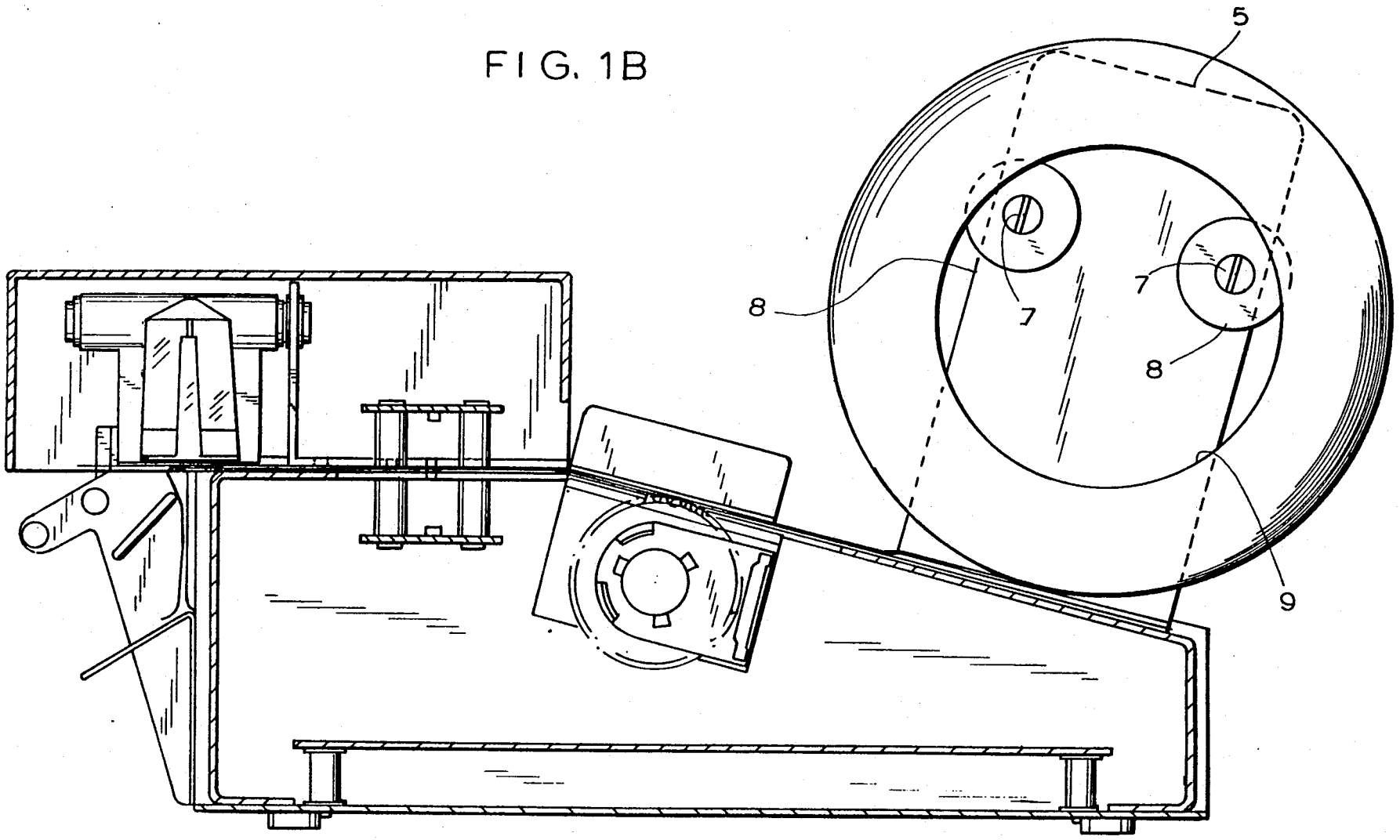
FIG. 1*b* is a side elevation view of a label printer in accordance with the preferred embodiment of the invention.

Referring now to FIGS. 1*a* and 1*b* of the drawings, there is shown a label printer 1 having a housing 3. Mounted on top of the housing 3 is a spooling frame 5 on which there are mounted two cylindrical shafts 7 for supporting a spool 9 on which there is wound an elongated web of a substrate 11 (see FIG. 2*a*) which serves as a backing for labels 13. The labels 13 have on their under surfaces an adhesive coating with a greater affinity for the label 13 than for the substrate 11.

Fixedly mounted within the housing 3 is the outer casing of an encoder 15 which has a rotatable shaft 17 on which there is fixedly mounted a driven wheel 19 which protrudes slightly above the upper surface of the housing 3.

Downstream of the spooling frame 5 and encoder 15 an electric eye 21 is mounted on the housing. The electric eye 21 has a light emitting diode 23 mounted beneath the upper surface of the housing 3 in alignment with an aperture in the upper surface of the housing 3 to permit light emitted by the diode 23 to be directed upwardly where it is sensed by a phototransistor receiver or sensor 25. A print head 27 is mounted on top of the housing 3 downstream of the electric eye 21.

Mounted at the end of the housing 3, distal from the spooling frame 5, is a delaminator 29 for separating the labels 13 from the substrate 11.

Figure 2A:
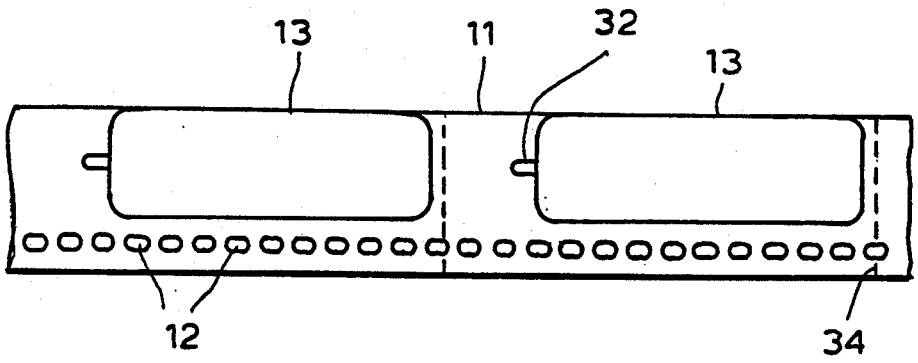
FIG. 2*a* is a top plan view of a length of a web of labels suitable for use with the preferred embodiment of the invention.

Referring to FIG. 2*a*, there is shown a segment of the outer surface of the substrate 11 with labels 13 removably adhered to it. The substrate 11 is wider than the width of the labels 13. The labels 13 are evenly spaced along the substrate 11 with a longitudinal axis parallel to and displaced from the longitudinal axis of the substrate 11 so that one of the long edges of each label 13 is flush with one edge of the substrate 11.

Figure 2B:
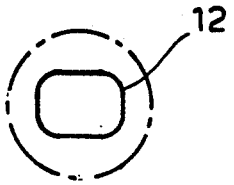
FIG. 2*b* is an enlarged view of a portion of the view of FIG. 2*a*.

Along the edge of the substrate 11, opposite the edge with which the labels 13 are flush, are evenly spaced apertures 12 forming sprocket holes for receiving sprockets 14 on the encoder wheel 19 as will be discussed below. The shape of each sprocket hole can be seen in the enlarged view of FIG. 2*b*. In the preferred embodiment of the invention, the labels 13 are each 1½" long and ½" wide. The substrate 11 is ¾" in width. The labels 13 are uniformly spaced along the substrate 11, ½" apart.

A lid 20 is pivotally mounted on the top deck of the housing 3. The lid 20 has a planar portion 26 with a slotted edge 28 to receive the sprocket wheel 19 and a transverse lip 30 by which the lid 20 can be pivoted upwardly about the intersection of the planar portion 26 and lip 30 to enable the substrate 11 to be placed over the sprockets 14 on the encoder wheel 19, and then pivoted downwardly to prevent the substrate 11 from becoming disengaged from the sprockets 14 on the wheel 19. The planar portion 26 of the lid 20 is apertured to receive screws 24 on which there are mounted nuts 22 which compress springs in engagement with the lid 20 to urge the lid 20 toward the downward position.

As can be seen from FIG. 2*a*, immediately before each label 13, in alignment with the longitudinal axis of the labels 13, is an axially aligned rectangular aperture 32, 1/16" wide and ⅛" long, which is sensed by the electric eye 21, as will later be described, for establishing a reference position for each label 13. Immediately behind each label 13, the substrate 11 is perforated along a line 34 transverse to the longitudinal axis of the labels 13 and substrate 11 to provide a tactile sensation to the user following printing of a label, thereby signalling when the label 13 should be removed.

The two spaced cylindrical shafts 7 project, outwardly, a distance slightly greater than the width of the substrate 11. The outward ends of the shafts 7 are terminated in circular flanges 8 of larger diameter to prevent the spool 9 from sliding off the shafts 7. There are, preferably, no moving parts mounted on the spooling frame 5.

The encoder 15 is a conventional shaft encoder that produces 500 digital pulses per revolution. The sprocket wheel 19 is mounted on the shaft 17 of the encoder. Evenly spaced around the circumference of the sprocket wheel 19 are the sprocket teeth 14. The spacing of the sprocket teeth is the same as the spacing of the apertures 12 along the edge of the substrate 11. The sprocket wheel 19 is aligned with the apertures 12 in the substrate 11 so that the sprocket teeth 14 can be received in the apertures 12 of the substrate 11 as the substrate 11 passes over the sprocket wheel 19.

The rate at which the encoder 15 generates digital pulses is directly proportional to the velocity of the substrate 11 as it moves from the spool 9 downstream. When the substrate 11 is stationary, no pulses are generated by the encoder 15.

The light emitting diode 23 serves as an electromagnetic energy source and is mounted on a small circuit board 36 below the upper deck of the housing 3. The substrate 11, with labels 13 adhered to its upper surface, passes over an aperture in the top surface of the housing having a diameter of approximately 0.25". The phototransistor 25, which is mounted on a circuit board 54 above the upper surface of the housing 3, serves as a receiver for sensing the light emitted by the L.E.D. 23 and transmitted through the substrate 11 and labels 13.

The phototransistor receiver 25 generates a signal having a magnitude which is a function of the intensity of the light received from the emitter 23. Because the amount of light that passes through the substrate 11, alone, is greater than the light transmitted through a portion of the substrate 11 covered with a label, the edge of the label 13 may be detected by the electric eye phototransistor receiver 25. In the preferred embodiment of the invention, the increased light transmittance through the rectangular aperture 32 immediately in front of each label 13 is used to signal the location of a label 13 to define a reference position for the label.

The intensity of the light from the emitter 23 which is sensed at the receiver 25 is at a maximum when the aperture in the substrate 11 is in alignment with the aperture in the upper deck of the housing 3 whereat the light emitted by the LED 23 is sensed by the phototransistor 25.

Figure 3:
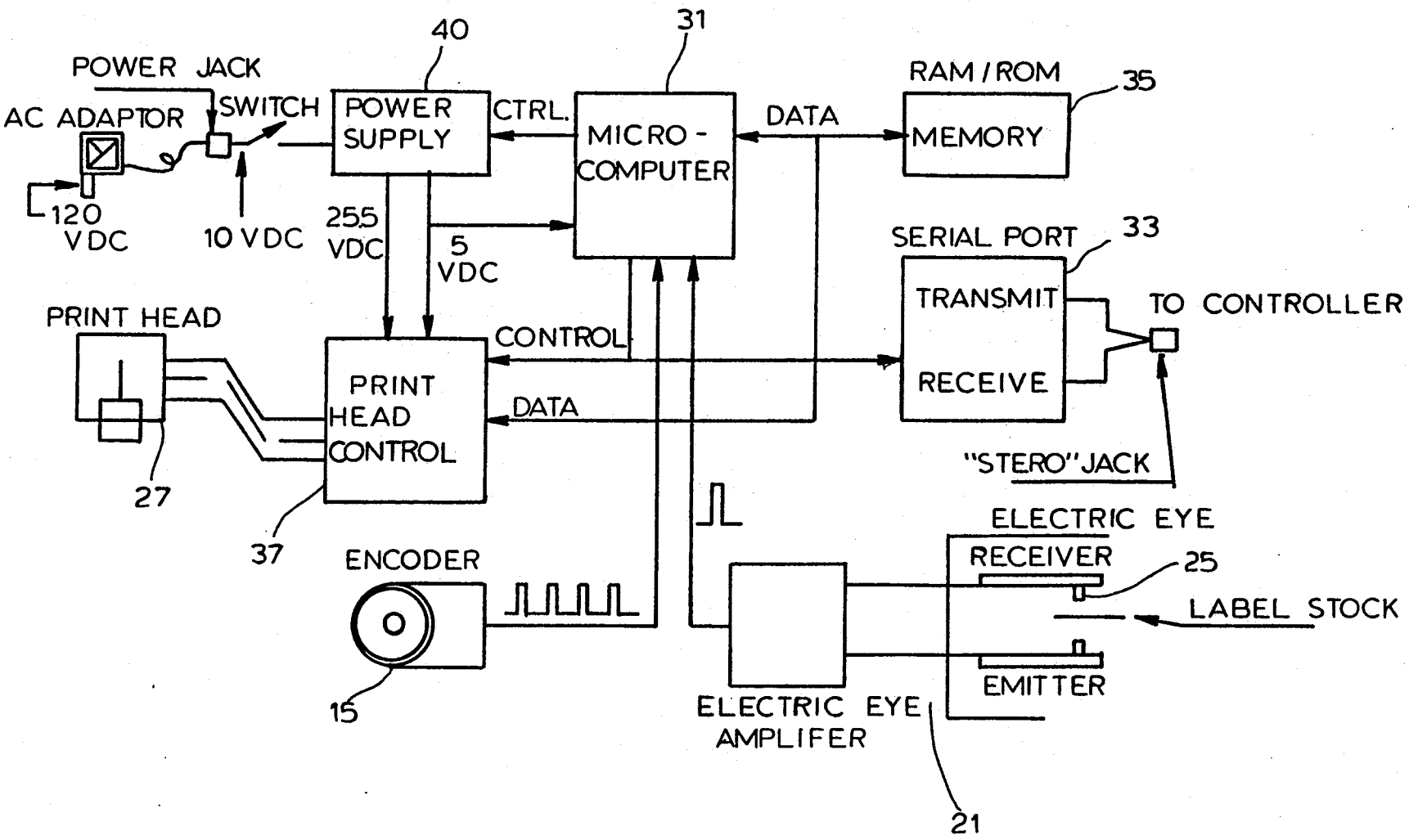
FIG. 3 is a schematic block diagrammatic view of a label printer in accordance with the preferred embodiment of the invention.

Referring now to FIG. 3, there is shown a schematic block diagram of the electronic control circuitry for the label printer of the invention. A microcomputer 31 is connected to receive signals from the encoder 15 and the electric eye phototransistor 25. Each signal from the electric eye phototransistor 25 tells the microcomputer 31 that the corresponding label 13 is at a predetermined referenced position. Following each output signal from the electric eye 21, pulses from the encoder 15 are counted by the microcomputer 31 to determine the instantaneous location of the next label 13 with respect to the print head 27 that is mounted on the housing 3 a predetermined fixed distance from the electric eye phototransistor 25.

A serial port 33 is connected to receive data from an external controller, e.g., a personal computer, to be imprinted on the labels 13. Representations of the characters or images to be printed that are received at the serial port 33 are transmitted to the microcomputer 31 which causes them to be stored in a random access memory (RAM) 35. The addresses of the pixels forming the characters and images stored in the RAM 35 correspond to the positions on the label 13 which are to be imprinted with the characters or images. Each time a pulse is generated by the encoder 15, the microcomputer 31 scans the corresponding addresses in RAM 35 and determines which of the jet nozzles of the print head 27 is to be fired during each cycle in which the print head ink jet nozzles are sequentially enabled.

Each character in RAM 35 is defined by a matrix having 8 vertically aligned pixels by 6 horizontally aligned pixels. Six pulses from the encoder 15 are required to cause a single character or image to be printed. Each of the six pulses results in one column of pixels, of which the character or images is comprised to be printed by the 8 jet nozzles of the print head 27.

Figure 6:
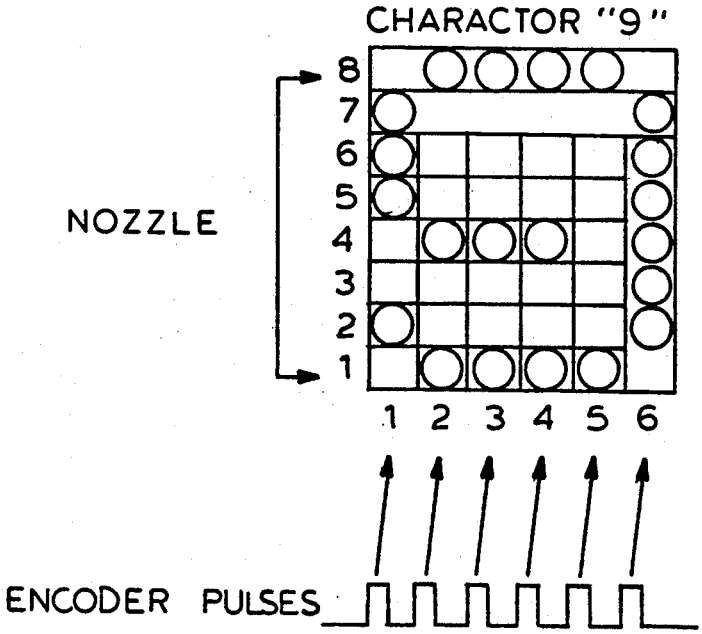
FIG. 6 is a view showing how a character is printed by a label printer in accordance with the preferred embodiment of the invention.

Referring to FIG. 6, there is shown an 8×6 matrix representation of the numeral character "9" with a corresponding train of pulses from the encoder, each of which sequentially causes the printing of one of six vertical columns of dots to form the character.

Two encoder pulses are counted after the completion of each character to provide spacing between characters. In the preferred embodiment of the invention, a maximum of 12 characters can be printed. However, this number can be expanded by using a larger RAM 35, different labels 13, and/or different schemes for generating and counting reference signal pulses from the electric eye 21 and encoder pulses from the encoder 15.

The print head 27 can be an ink jet print head, a dot matrix impact print head, or any other type of print head capable of selectively printing selected ones of a line of dots transverse to the path along which the substrate 11 is moved during printing. In the preferred embodiment of the invention, the print head 27 is a Hewlett Packard Ink Jet print head which has 12 jet nozzles evenly spaced along a line transverse to the direction of travel of the substrate 11 from the spool 9 over the encoder wheel 19 of encoder 15, between the emitter 23 and phototransistor receiver 25 of electric eye 21, and under the print head 27. The print head 27 is powered by a power supply 40.

In the preferred embodiment of the invention, the microcomputer 31 has an 8-bit architecture. Therefore, only 8 of the 12 jet nozzles of the Hewlett Packard ink jet print head are used. All 12 of the jet nozzles could be used at the cost of providing more complex electronics to control the print head.

Each of the 8 jet nozzles of the ink jet print head that is in use is capable of projecting an ink droplet to print a dot on a label 13 beneath it upon receipt of an electrical pulse having an amplitude of approximately 23 volts dc and a pulse width of 5 microseconds. In order to prevent overloading of the power supply by the simultaneously firing of two or more of the jet nozzles, the jet nozzles are fired, sequentially, at very high speed. For example, to print a vertical line in which all 8 of the jet nozzles are fired, each of the jet nozzles is sequentially fired for a time period of five micro seconds followed by a time interval of one microsecond during which none of the jet nozzles is fired. Hence, the total time to fire all 8 jet nozzles to draw a straight line transverse to the direction of travel of the labels 13 is 48 microseconds.

Figure 5:
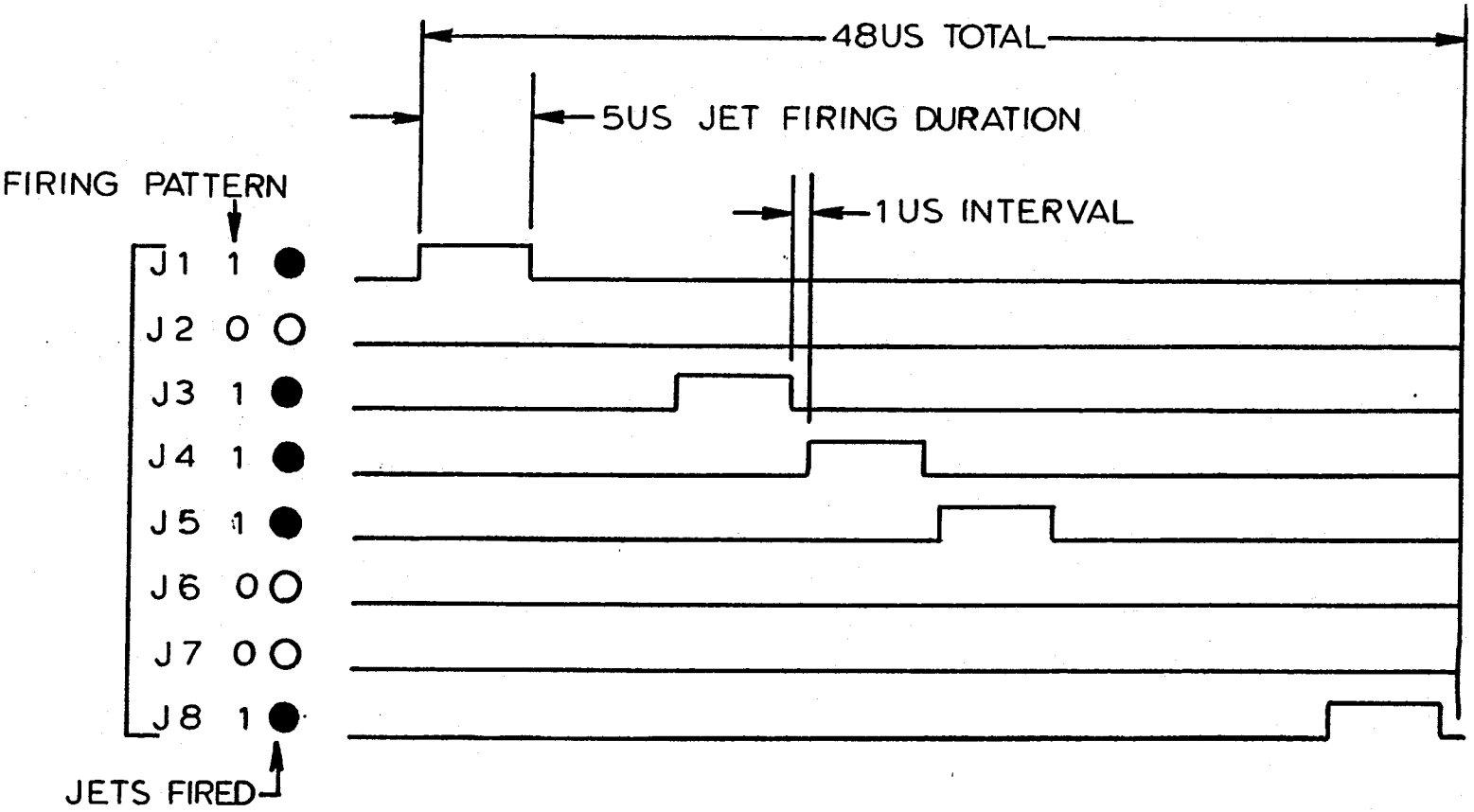
FIG. 5 is an electrical signal timing diagram for a label printer in accordance with the preferred embodiment of the invention.

Another example, wherein jet nozzles nos. J1, J3, J4, J5, and J8 are the only ones fired is illustrated in the timing diagram of FIG. 5. Referring to FIG. 5, jet nozzle J1 is fired for a period of 5 micro seconds. There is then a hiatus of one microsecond after which jet nozzle J2 is enabled for five microseconds but not fired. There is then another hiatus of one microsecond. Twelve microseconds after the start of the firing scan of the jet nozzles, jet nozzle J3 is enabled and fired for five microseconds after which there is a one microsecond interval during which there is no firing. Thereafter, 18 microseconds from start, jet nozzle J4 is enabled and fired for 5 microseconds, and then at 24 microseconds from start, jet nozzle J5 is fired for five microseconds. There is then a hiatus of one microsecond after which jet nozzles 6 and 7 are sequentially enabled at 30 microseconds and 36 microseconds from start, but not fired. At 42 microseconds from start, jet nozzle J8 is enabled and fired for five microseconds after which there is a one microsecond hiatus completing the 48 microsecond scanning period for sequentially enabling each of the 8 jet nozzles of the print head 27.

Figure 4:
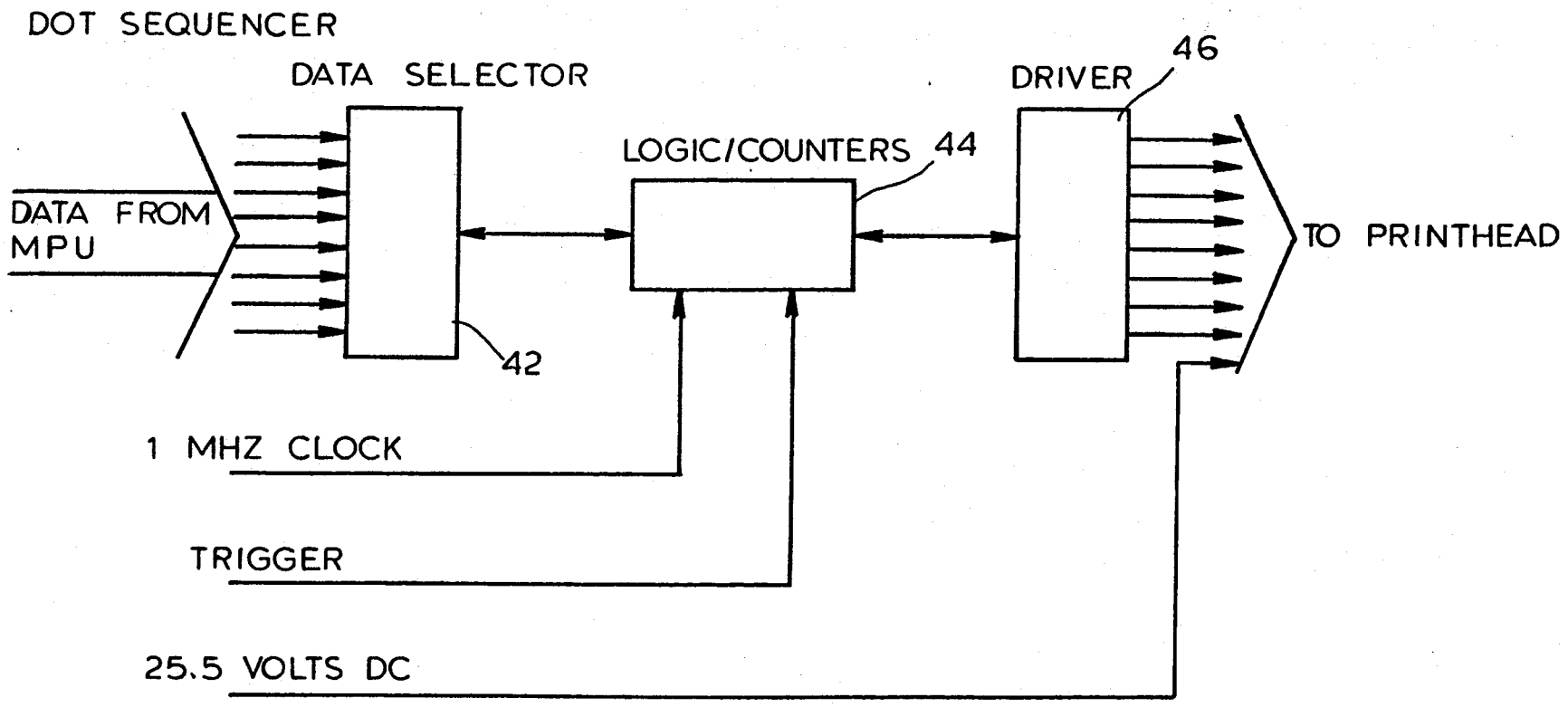
FIG. 4 is a schematic block diagrammatic view of a portion of a label printer in accordance with the preferred embodiment of the invention.

A print head controller 37 has an input connected to the microcomputer 31 and an output connected to the print head 27. Within the print head controller 37 is a dot sequencer logic circuit, illustrated in FIG. 4, that controls the firing of the ink jets within the print head 27.

As the microcomputer 31 scans the addresses of the RAM 35 whereat representations of the pixels making up the character or image to be printed are stored, each column of the six columns of pixels making up an image or character is presented by the microcomputer 31 to a data selector as an 8 bit word. Each of the 8 bits can be represented by a 0 or a 1. A 0 will disable the corresponding jet from firing while a 1 enables firing of the corresponding jet.

Firing of the enabled jets takes place in response to generation of pulses by the encoder 15. The encoder pulses are transmitted to the microcomputer 31 which, in turn, presents an 8 bit data word to a data selector circuit in the print head controller 37. The dot sequencer logic circuit of the print head controller 37 includes logic counters 44 which receive a 1 mHz clock signal, for timing, from the microcomputer 31. In addition, a trigger signal from the microcomputer 31, responsive to each pulse generated by the encoder 15, is applied to the logic counters 44 to initiate one firing of a vertical row of dots by the ink jet nozzles.

A driver chip 46 which, in the preferred embodiment of the invention is a type UCN5816A, provides the firing voltages to the 8 ink jet nozzles. The driver chip 46 receives a 4 bit address from the logic counter circuit 44 specifying one of its outputs. The logic counter circuit fires an ink jet by enabling the driver chip 46 at the right time for the proper time duration. The outputs of the driver chip 46 are capable of sinking up to 300 milliamperes and have a 60 volt tolerance.

Power of 25.5 volts dc is provided to a common conductor in the print head 27 to which all 8 of the ink jets are connected. Each ink jet is fired by sinking its control line to ground. Since the load is non-inductive, no flyback suppression measures are taken at the driver chip 46 even through the chip 46 has flyback suppression capability. Although the driver chip 46 has 16 sinking driver outputs, only the first 8 are used, corresponding to the first 8 of the 12 ink jets of the print head 27.

In order to prevent adjacent ink jets from firing, one right after the other, the lines from the microcomputer 31 output bus leading to the data selector 42 are scrambled. This provides the microprocessor 31 with a normal 1, 2, 3, 4, 5, 6, 7, 8 data arrangement while obtaining a non-sequential firing sequence of the jets, e.g., the ink jets in the preferred embodiment of the invention are fired in the order 4, 8, 2, 6, 3, 7, 1, 5.

After each label 13 is imprinted while still affixed to the substrate 11, it is fed, with the substrate 11, to the delaminator 29. The delaminator 29 has a zig-zag bar 51 under which the leading end of the substrate 11 is pulled. On top of the delaminator 29 are two parallel cylindrical pins 52 forming a porch over which the label 13 rides as the substrate 11 is caused to peel away from the label 13 when the label 13 is pulled away from the housing 3. The perforation 34, running across the substrate 11 immediately behind each label 13, causes resistance to be encountered when the perforation 34 encounters the forward edge 53 of the top deck of the printer housing 3.

Normally, the substrate 11 is stiff enough to curve, forming a radius, as it passes over the edge 53 of the housing 3. However, when the perforation reaches the edge 53, the substrate 11 bends sharply over that edge thereby requiring an increased pull to continue advancing the substrate 11 through the printer. This increase in pull provides tactile feedback to the user to prevent overpulling the label stock, that is, to notify the user that sufficient pulling has occurred to remove one label.

In use, a spool 9 on which a length of the substrate 11 containing spaced label 13 is wound, is suspended from the shafts 7 on the spooling frame 5 with the clockwise wound side of the spool facing outward. The substrate 11 is then threaded over the encoder wheel 19 with the sprockets 14 received in the substrate 11 apertures 12 protruding through the slot 28 in the lid 20 which keeps the substrate 11 from becoming separated from the sprockets 14. The end of the substrate 11 is pulled through the electric eye 21 between the emitter 23 and sensor 25, under the print head 27, with the printing surface of the labels 13 facing the ink jet nozzles, and then under the zig-zag bar 51.

The label printer 1 is then ready to print one or more characters or images stored in the RAM 35 under control of the microcomputer 31.

To print the stored character or image, the end of the substrate 11 is pulled away from the housing 2 causing the next label 13 on the substrate 11 to pass beneath the print head 27. As the label 13 moves under the print head 27, the ink jet nozzles fire to print the character or image. The speed at which the substrate 11 is pulled does not affect the printing as the ink jet nozzles fire only when each designated area on the label 13 is in position to receive a droplet of ink. The substrate 11 may even be stopped and then started during the pulling motion without affecting the printing.

After a label 13 is imprinted, the perforation 34 on the substrate 11 engages the edge 53 of the top deck of the printer housing thereby causing a "tug" opposing the pulling motion. At this time, the label 13 has separated from the substrate 11 and is disposed atop of the porch formed by the label supporting pins 52. The label 13 may then be removed by hand and adhered to a surface by applying pressure.

It is to be appreciated that the foregoing is a description of a preferred embodiment of the invention to which variations and alterations may be made without departing from the sprint and scope of the invention which is defined in the following claims. For example, the stationary spooling shafts 7 may be replaced by rollers. The sprocket wheel 19 on the encoder 15 may be replaced by a friction wheel in which case the sprocket holes 12 on the substrate 11 would not be needed. Where fiction is used to rotate the encoder, the widths of the labels 13 and substrate 11 can be the same and their edges coextensive. The electric eye 21 can be replaced by a mechanical switch actuated by an aperture on the substrate 11. The print head 27 may be an impact print head which uses solenoid actuated pins and a ribbon to imprint dots on the labels 13. The microcomputer 31, RAM 35, and print head 27 may be chosen to print a greater number of dots by using more jet nozzles or pins controlled by transmission of data formed from a number of bits greater than that utilized in the preferred embodiment of the invention herein disclosed.

I claim:

1. In a printer having a housing, web positioning means mounted on said housing for supporting a web having a surface which is to be imprinted with one or more images, storage means for storing addresses of pixels forming images to be imprinted on the web, a print head operatively connected to said storage means and fixedly mounted on said housing, said print head having a plurality of spaced aligned dot printing means, each of which can imprint a dot on said web corresponding to a point on said images, the improvement which comprises, an encoder mounted on said housing, said encoder having web engaging means fixedly mounted thereon for positively engaging said web, said printer being motorless, and said web positioning means supporting said web while permitting longitudinal movement thereof whereby said web can be manually grasped and translated in a direction parallel to its axis, the motion of said web being imparted to said web engaging means to cause movement thereof, said encoder generating pulses in response to movement of said web from a reference position, and, counter means operatively connected to said storage means for counting said pulses and producing print enabling signals corresponding to said pulse count and said stored addresses, said dot printing means being operatively connected to said counter means and responsive to said enabling signals for printing dots corresponding to said image unaffected by variations in the velocity of movement of said web.

2. A printer according to claim 1 wherein said web engaging means is rotatably mounted with respect to said housing and movement of said web causes said encoder to rotate.

3. A printer according to claim 2 wherein said web engaging means comprises a wheel having sprockets adapted to engage apertures in said web for positive engagement during movement of said web relative to said housing.

4. A printer according to claim 1 further comprising index sensing means responsive to the position of said web for providing a reference signal when said web is at a reference position, said print head being operatively connected to said sensing means and responsive to said sensing means reference signal for printing a dot corresponding to said image only when the area of said web on which the point is to be imprinted is a predetermined distance from the reference position.

5. A printer according to claim 4 wherein said sensing means comprises a source of electromagnetic energy mounted on said housing for projecting said energy across the path of said web and a sensor mounted on said housing to receive the energy transmitted through said web.

6. A printer according to claim 4 further comprising spooling means for supporting a length of said web in wound configuration and means mounted on said housing.

7. A printer according to claim 1 wherein said print head is an ink jet print head and said dot printing means are ink jets, each adapted to spray droplets of ink.

8. A printer according to claim 4 further comprising label separation means mounted on said housing, whereby an end of said web can be grasped for moving said web through said separating means whereat one end of said label is peeled away from said web.

9. A motorless label printer comprising, a housing, a web including an elongated substrate and a plurality of labels releasably affixed to said substrate in spaced relationship, each label having a surface which is to be imprinted with one or more images, web positioning means mounted on said housing for supporting said web while permitting longitudinal movement thereof, whereby said web can be manually grasped and translated in a direction parallel to its axis, storage means for storing addresses of pixels forming images to be imprinted on each label, a print head operatively connected to said storage means and fixedly mounted on said housing, said print head having a plurality of spaced aligned dot printing means, each of which can imprint a dot on a label corresponding to a point on the image, an encoder mounted on said housing for movement with respect thereto, web engaging means fixedly mounted on said encoder for positively engaging said web whereby motion of said web is imparted to said web engaging means to cause movement thereof, said encoder generating pulses in response to movement of said web from a reference position, and counter means operatively connected to said storage means for counting said pulses and producing print enabling signals corresponding to said pulse count and said stored addresses said print head being responsive to said enabling signals for printing dots corresponding to said image unaffected by variations in the velocity of movement of said web.

10. A printer according to claim 9 wherein said encoder is rotatably mounted with respect to said housing and movement of said web causes said encoder to rotate.

11. A printer according to claim 10 wherein said web substrate has spaced apertures along one of its edges and said engaging means comprises a wheel having sprockets adapted to be received in the apertures in said web for positive engagement during movement of said web relative to said housing.

12. A printer according to claim 9 wherein said substrate has an index for each label, and further comprising index sensing means responsive to the position of said web for providing a reference signal when said web is at a reference position, said print head being operatively connected to said sensing means and responsive to said sensing means reference signal for printing a dot corresponding to said image only when the area of said web on which the point is to be imprinted is a predetermined distance from the reference position.

13. A printer according to claim 12 wherein said sensing means comprises a source of electromagnetic energy mounted on said housing for projecting said energy across the path of said web and a sensor mounted on said housing to receive the energy transmitted through said web.

14. A printer according to claim 12 where in said index is an edge of said label, areas of said substrate between said labels transmitting more energy than areas of said substrate covered by said labels, said sensing means being responsive to the change in energy transmission as the edge of each label traverses said sensing means.

15. A printer according to claim 12 wherein said index is an aperture in said substrate, the aperture transmitting more energy than said substrate, said sensing means being responsive to the change in energy transmission as each index aperture traverses said sensing means.

* * * * *